US009598199B2

(12) United States Patent
Koller et al.

(10) Patent No.: US 9,598,199 B2
(45) Date of Patent: Mar. 21, 2017

(54) LABELLING APPARATUS AND LABELLING PROCESS FOR THE LABELLING OF CONTAINERS AS WELL AS PLANT FOR THE TREATMENT OF CONTAINERS

(71) Applicant: KRONES AG, Neutraubling (DE)

(72) Inventors: Juergen Koller, Walderbach/Kirchenrohrbach (DE); Thomas Zech, Donaustauf (DE); Dieter Leykamm, Neutraubling (DE)

(73) Assignee: KRONES AG (DE)

( * ) Notice: Subject to any disclaimer, the term of this patent is extended or adjusted under 35 U.S.C. 154(b) by 34 days.

(21) Appl. No.: 14/085,559

(22) Filed: Nov. 20, 2013

(65) Prior Publication Data

US 2014/0076476 A1 Mar. 20, 2014

Related U.S. Application Data

(62) Division of application No. 12/876,893, filed on Sep. 7, 2010, now abandoned.

(30) Foreign Application Priority Data

Sep. 9, 2009 (DE) ..... 10 2009 040 346

(51) Int. Cl.
*B65C 9/40* (2006.01)
*B65C 9/42* (2006.01)

(52) U.S. Cl.
CPC . *B65C 9/42* (2013.01); *B65C 9/40* (2013.01)

(58) Field of Classification Search
CPC .... B65C 3/08; B65C 3/12; B65C 3/16; B65C 9/40; B65C 9/42; B65G 2203/041; B65G 2203/042; B65G 2203/044
(Continued)

(56) References Cited

U.S. PATENT DOCUMENTS 3,153,478 A 10/1964 Meyer ..... 198/209
3,559,617 A 2/1971 Seragnoli ..... 118/6
(Continued)

FOREIGN PATENT DOCUMENTS

CA 1322995 10/1993 ..... B65C 3/08
CN 1215640 5/1999 ..... B23D 25/12
(Continued)

OTHER PUBLICATIONS

Japanese Office Action issued in related application No. 2010-196662, dated Mar. 4, 2014 (8 pgs).
(Continued)

*Primary Examiner* — George Koch
(74) *Attorney, Agent, or Firm* — Hayes Soloway P.C.

(57) ABSTRACT

A labelling apparatus for the labelling of containers includes at least one first labelling device, a storage device and a control device. The at least one first labelling device applies a label from a first strip of labels to a container. The control device controls the labelling of the containers based on a detection result of a first detection device which detects a pattern of containers and container-absence points in a supply flow of the containers to the first labelling device, and/or on the basis of a detection result of a second detection device which detects a filling state of the labels in the storage device. The control interrupts the labelling of the container if the first detection device detects a pre-determined pattern of containers and container-absence points and/or if the second detection device detects a pre-determined filling state of the labels in the storage device.

16 Claims, 5 Drawing Sheets

(58) Field of Classification Search
USPC ..... 156/351, 352, 361, 362, 363, 368, 378; 198/341.02, 341.03, 341.05, 341.07; 700/230
See application file for complete search history.

(56) References Cited

U.S. PATENT DOCUMENTS

| | | | | |
|---|---|---|---|---|
| 3,607,547 | A | 9/1971 | Kronseder | 156/351 |
| 3,908,815 | A | 9/1975 | Carter | 198/37 |
| 4,369,214 | A | 1/1983 | Pfülb et al. | 427/428 |
| 4,417,940 | A | 11/1983 | Koster | 156/351 |
| 4,512,842 | A | 4/1985 | Schneider | 156/357 |
| 5,024,717 | A | 6/1991 | Winter | 156/354 |
| 5,660,676 | A * | 8/1997 | Brooks | 156/361 |
| 6,436,330 | B1 | 8/2002 | Winter | 264/509 |
| 2001/0001376 | A1 | 5/2001 | Kneppe et al. | 83/663 |
| 2002/0040767 | A1* | 4/2002 | Yang | 156/363 |
| 2002/0124945 | A1* | 9/2002 | Muir et al. | 156/245 |
| 2003/0034111 | A1* | 2/2003 | Oldenburg et al. | 156/64 |
| 2004/0089423 | A1* | 5/2004 | Nielsen | 156/542 |
| 2006/0289274 | A1* | 12/2006 | Knepple | B65G 37/02 198/460.1 |
| 2007/0220835 | A1 | 9/2007 | Till | 53/471 |
| 2009/0071608 | A1 | 3/2009 | Thomas et al. | 156/516 |
| 2010/0051179 | A1 | 3/2010 | Eder et al. | 156/157 |
| 2010/0059331 | A1 | 3/2010 | Finger | 198/341.09 |

FOREIGN PATENT DOCUMENTS

| | | | |
|---|---|---|---|
| DE | 33 04 191 | 8/1984 | B65C 9/16 |
| DE | 33 14 730 | 10/1984 | B65C 9/10 |
| DE | 3314730 | 10/1984 | B65C 9/10 |
| DE | 88 08 030.7 | 12/1988 | B65C 9/18 |
| DE | 39 15 987 | 2/1990 | B65C 9/42 |
| DE | 198 19 731 | 11/1999 | B65C 3/08 |
| DE | 10 2006 043 260 | 3/2008 | B65C 9/18 |
| EP | 2 042 437 | 4/2009 | B65C 9/18 |
| JP | S4844099 | 6/1973 | A47F 3/04 |
| JP | H11189227 | 7/1999 | B65C 9/18 |
| JP | 2000326943 | 11/2000 | B65C 5/40 |
| JP | 2006-82848 | 3/2006 | B65C 9/40 |
| WO | WO 2008/071293 | 6/2008 | B65G 43/00 |
| WO | WO2010/072654 | 7/2010 | B65C 9/40 |

OTHER PUBLICATIONS

Office Action issued in related U.S. Appl. No. 12/876,893, dated May 25, 2012 (31 pgs).
Office Action issued in related U.S. Appl. No. 12/876,893, dated Oct. 23, 2012 (23 pgs).
Office Action issued in related U.S. Appl. No. 12/876,893, dated Mar. 4, 2013 (17 pgs).
Office Action issued in related U.S. Appl. No. 12/876,893, dated Jun. 20, 2013 (19 pgs).
Chinese Office Action issued in corresponding application No. 2010102864594, dated Jul. 23, 2012 (15 pgs).
Chinese Office Action, Application No. 2008101836566, dated Nov. 2, 2011 (7 pgs).
European Office Action, Application No. 10 175 122.0, dated Mar. 12, 2012 (6 pgs).
European Search Report, Serial No. 10175122.0 dated Jan. 19, 2011 (6 pgs).

* cited by examiner

LABELLING APPARATUS AND LABELLING PROCESS FOR THE LABELLING OF CONTAINERS AS WELL AS PLANT FOR THE TREATMENT OF CONTAINERS

CROSS REFERENCE TO RELATED APPLICATION

This application is a divisional of U.S. application Ser. No. 12/876,893, filed Sep. 7, 2010, now abandoned which application in turn claims priority from German patent application Ser. No. 10 2009 040 346.9, filed Sep. 9, 2009.

BACKGROUND OF THE INVENTION

The invention relates to a labelling apparatus and a labelling process for the labelling of containers as well as a plant for the treatment of containers.

A plant, which comprises in combination a stretch blow-moulding apparatus, a labelling apparatus and a filling apparatus as a block design, is being tested at present by the Applicants.

In a plant of this type, pre-forms are blow-moulded to form bottles in a first treatment step which is carried out by the stretch blow-moulding apparatus. The bottles are labelled in a second treatment step which is carried out by the labelling apparatus. The bottles are filled and closed in a third treatment step which is carried out by the filling apparatus.

The problem arises in this case that the process sequence can have faults during the first treatment step, in particular in the start-up of the plant, but also when the process is under way. A fault of this type is for example that a pre-form is riot heated to an adequate degree. As a result, the bottle blow-moulded from the insufficiently heated pre-form is defective. In consequence, the defective bottle is separated out before being supplied to the second treatment step. As a result a gap occurs in the otherwise continuous flow of bottles between the stretch blow-moulding apparatus and the labelling apparatus.

In normal operation the labelling apparatus cuts individual labels, which are arranged one behind the other on a strip of labels, from the strip of labels by means of a cutting device. Alternatively, the labelling apparatus can also detach adhesive labels from a carrier strip. This means that the individual labels are arranged one after the other, and no gap occurs in the size of a label In this case, after a label has been separated from the strip of labels, the labelling apparatus applies it in each case to the bottle by means of a labelling device. In normal operation, therefore, the labelling apparatus is set up in such a way that the bottles are supplied to it in a continuous manner. A labelling apparatus of this type is described for example in EP 2 042 437 A1, DE 33 04 191 C2, DE 10 2006 043 260 A1 2008.03.27 or WO 2008/071293.

If, in the case of the plant currently being tested, a gap occurs in the otherwise continuous flow of bottles between the stretch blow-moulding apparatus and the labelling apparatus on account of the above-described fault in the stretch blow-moulding apparatus, the problem arises that the labelling apparatus is set up in normal operation in such a way that it would apply a label to a bottle not present or to a gap between the bottles.

Consideration has therefore been given to providing the labelling apparatus of the plant—currently being tested—with a control device which is intended to prevent a label being dispensed to a gap between bottles which are supplied from the stretch blow-moulding apparatus to the labelling apparatus. To this end it is possible for the control device to be designed in such a way that it can bridge individual gaps by a stoppage of the endless strip of labels, since the continuous dispensing of labels is interrupted by this. In order to re-set the continuous running of the labelling apparatus again, however, after a gap —depending upon the nature of the material of the label —the control device requires a period of time which corresponds to the supply of a plurality of bottles in succession to the labelling apparatus.

In addition, it has been recognized during the testing that when a combination of a plurality of gaps/bottles/gaps/bottles are supplied in succession to the labelling apparatus the risk arises that the re-setting of the labelling apparatus will no longer operate and the strip of labels will be torn. Such a situation can lead to the stoppage of the labelling apparatus and the plant and thus of the entire process, and this results in a corresponding reduction in efficiency of the plant and an unacceptable loss of material.

In addition, there is the problem that an automatic gluing of strips of labels, which is necessary to ensure a continuous operation of the labelling apparatus and thus also of the block plant described above, does not operate in a reliable manner with a high degree of efficiency of the block plant. A reliable gluing would make a slowing-down necessary during the gluing phase, but this is not feasible with the quality of the containers produced by the stretch blow-moulding apparatus. As a consequence thereof the entire block plant would then have to be stopped, but this results in a reduction in efficiency.

As a solution to this problem, consideration has been given to using a labelling apparatus in conjunction with a separate labelling magazine, possibly even without gluing. It would then also be possible for a second labelling apparatus with gluing to be used in the so-called tandem operation, in which the two labelling apparatus label every second container in an alternate manner. These two solutions, however, incur considerable costs.

The object of the invention is therefore to provide a labelling apparatus and a labelling process for the labelling of containers as well as a plant for the treatment of containers, in which faults of an apparatus arranged upstream of the labelling apparatus or faults or delays in the gluing of strips of labels do not lead to a stoppage of the labelling apparatus and thus of the plant

SUMMARY OF THE INVENTION

The object is attained by labelling apparatus which comprises at least one first labelling device for applying a label from a first strip of labels to a container, a storage device for storing the labels, and a control device for storing the labels, and a control device for controlling the labelling of the containers on the basis of a detection result of a first detection device which detects a pattern of containers and container-absence points in a supply flow of the containers to the first labelling device, and/or on the basis of a detection result of a second detection device which detects a filling state of the labels in the storage device, the control device being designed in such a way that it interrupts the labelling of the containers if the first detection device detects a pre-determined pattern of containers and container-absence points and/or if the second detection device detects a pre-determined filling state of the labels in the storage device.

In addition, the control device can be designed in such a way that it treats a pattern of containers and container-absence points—which is detected by the first detection device and which can load to a tearing of the strip of labels if the strip of labels is stopped at each container-absence point—as a whole as a labelling gap between the containers.

Furthermore, it is possible for the control device to be designed in such a way that it treats a pre-determined pattern of containers and container-absence points—which is detected by the first detection device—as a whole as a labelling gap which is provided between two continuous sequences of containers in which no container-absence point is present in the supply flow of the containers to the first labelling device and which comprise at least one pre-determined number of containers.

In addition, the pre-determined pattern can be a pattern of containers and container-absence points which can lead to a tearing of the strip of labels when the strip of labels is stopped at each container-absence point.

It is preferable for the pre-determined number of the continuous sequence of containers to be a number of preferably five containers.

Furthermore, it is also possible for the control device to be designed in such a way that it stops the strip of labels for the duration of the labelling gap.

The labelling apparatus can in addition comprise a second labelling device for applying a label from a second strip of labels to a container. In this case the first and second labelling devices can be designed in such a way that they apply a label alternately to every second container of a common supply flow of the containers to the labelling apparatus, the first detection device detecting—in the common supply flow of the containers to the labelling apparatus—a pattern of containers and container-absence points which are supplied to the first labelling device, and a third detection device detecting—in the common supply flow of the containers to the labelling apparatus—a pattern of containers and container-absence points which are supplied to the second labelling device. In this case the control device can be designed in such a way that it controls the labelling of the containers on the basis of a detection result of the first and third labelling devices.

In addition, the labelling apparatus can have a separation device for separating out the containers not labelled by the labelling apparatus from the flow of containers.

The object specified above is additionally attained by a plant which comprises a stretch blow-moulding apparatus for producing a plastics-material container from a pre-form, a labelling apparatus, as described above, to which the plastics-material containers produced by the stretch of blow-moulding apparatus are supplied, and comprise a filling apparatus for filling with a liquid the plastics-material containers supplied by the labelling apparatus and for closing the plastics-material containers filled with the liquid.

The plant can in addition have a separation device for separating out the containers not labelled from the flow of containers before the plastics-material containers are filled with a liquid by the filling apparatus.

The object named above is additionally attained by a labelling process which is carried out by a labelling apparatus which comprises at least one first labelling device for applying a label from a first strip of labels to a container, and a storage device for storing the labels, with the steps: detecting—in a first detection step—a pattern of containers and a container-absence points in a supply flow of the containers to the first labelling device and/or a filling state of the labels in the storage device, and controlling the labelling of the containers on the basis of a detection result of the detection step.

In this case the labelling apparatus can additionally a second labelling device for applying a label coming from a second strip of labels to a container, the first and second labelling devices applying a label in an alternate manner to every second container of a common supply flow of the containers to the labelling apparatus. As a result, the process can additionally comprise the steps: detecting—in a second detection step—a pattern of containers and container-absence points in a supply flow of the containers to the second labelling device and/or a filling state of the labels in the storage device, and controlling the labelling of the containers on the basis of a detection result of the first and second labelling steps.

It is additionally advantageous if the process comprises a step of separating out the plastics-material containers not labelled by the labelling apparatus from the flow of plastics-material containers.

BRIEF DESCRIPTION OF THE DRAWINGS

The invention is described in greater detail below with reference to the accompanying drawing and by way of embodiments. In the drawings.

DETAILED DESCRIPTION OF THE INVENTION (First Embodiment)

Figure 1:
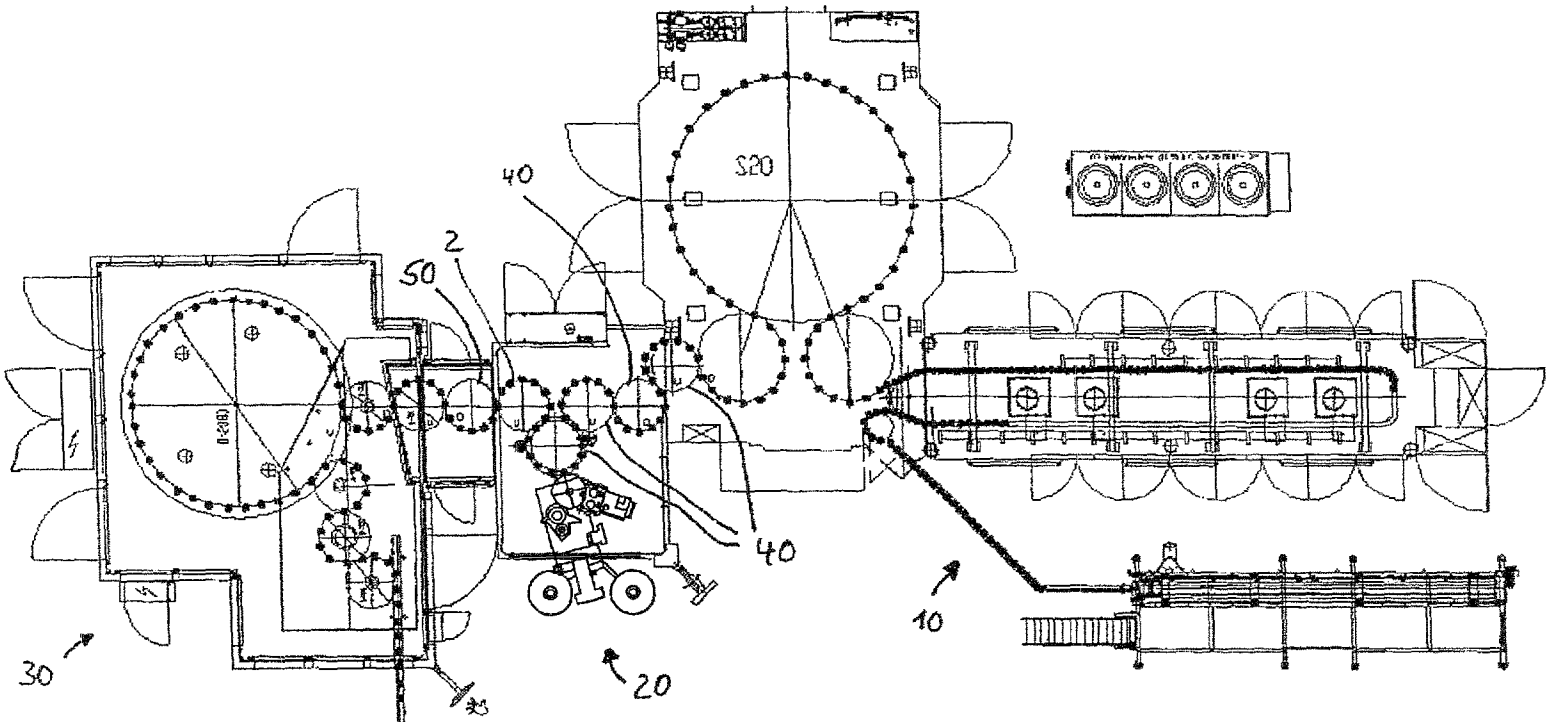
FIG. 1 is a diagrammatic plan view of a plant for the treatment of containers.

FIG. 1 shows a plant 1 for the treatment of containers 2, in which the containers 2 are pre-forms and containers which are produced from the pre-forms by a stretch blow-moulding process and which are illustrated in FIG. 1 by a ● or point. The plant 1 comprises a stretch blow-moulding apparatus 10, a labelling apparatus 20 and a filling apparatus 30.

In the stretch blow-moulding apparatus 10 pre-forms of plastics material, for example PET (PET=polyethylene terephthalate) or PP (polypropylene) etc., are heated in a heating device and are shaped by means of a stretch blow-moulding process into a container 2 for liquids, such as for example a bottle. The containers 2 for liquids, which are produced by the stretch blow-moulding apparatus 10, are supplied by way of conveying turntables 40 to the labelling apparatus 20, are labelled by the latter and are then supplied by way of conveying turntables 50 to the filling apparatus 30 which fills the containers 2 with at least one liquid and then closes them.

In the labelling apparatus 20, wrap-around labels are continuously applied in a high-capacity manner to containers 2 supplied consecutively or continuously in a single-track row.

The labelling apparatus 20 has a cutting device 21 for cutting the wrap-around labels from a strip of labels and a labelling device 22 for applying wrap-around labels to the containers 2. The wrap-around labels are glued by means of a gluing device for gluing the leading and trailing edges of a wrap-around label and are then transferred to a container 2 moving past on a conveying turntable 40. Alternatively, the labelling apparatus can also detach adhesive labels from a carrier strip by means of a label-strip bending device (not shown).

The precise design of the labelling apparatus 20 is as known from the prior art, and a labelling process of a container with the labelling apparatus 20 likewise takes place as known from the prior art. For example EP 2 042 437 A1, DE 33 04 191 C2, DE 10 2006 043 260 A1, 2008.03.27 or WO 2008/071293 may be named as prior art in this context. In this case, therefore, the labelling apparatus 20 and a labelling process of a container with the labelling apparatus 20 are described in detail only in the context which is important for the present invention.

Figure 2:
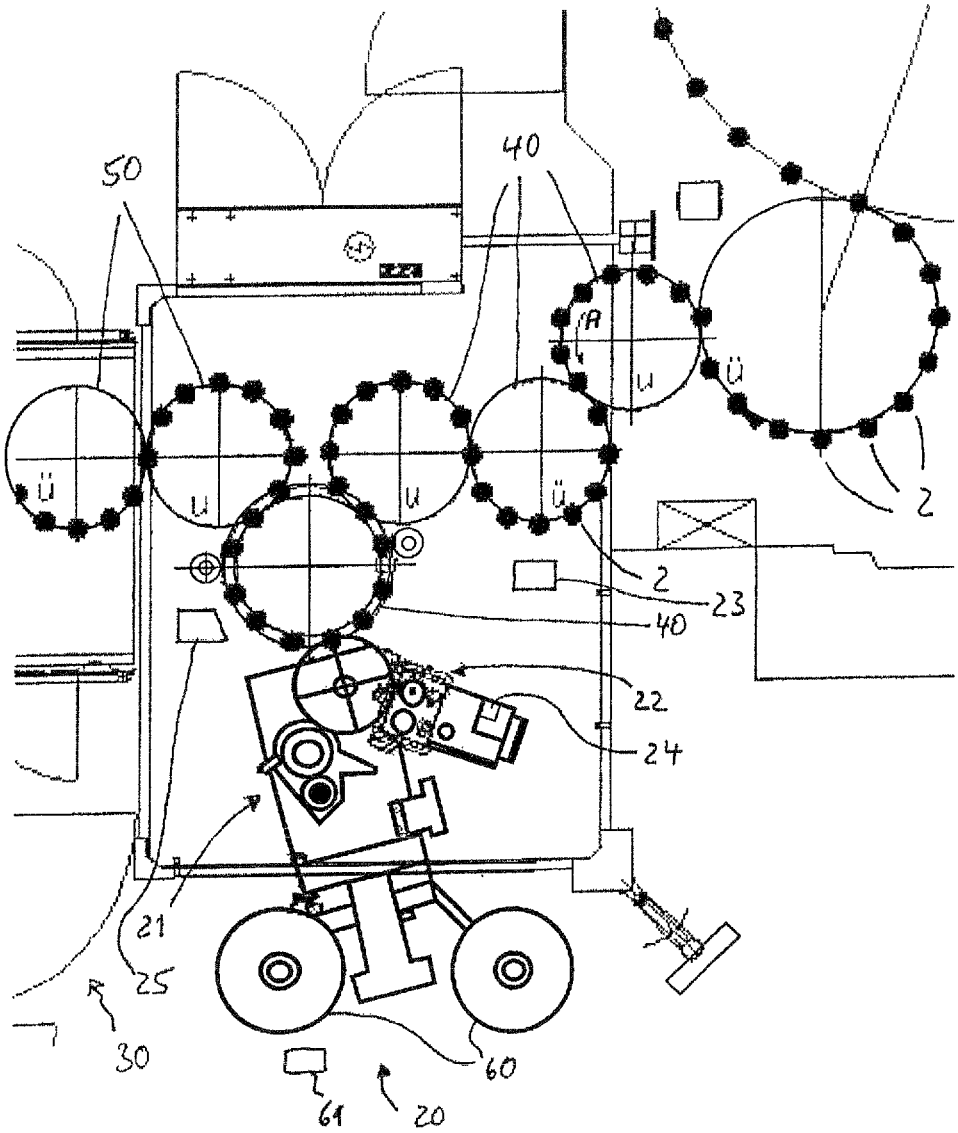
FIG. 2 is a diagrammatic plan view of a detail of the plant as shown in FIG. 1 in the case in which containers are continuously supplied to the labelling apparatus.

As shown in FIG. 2, the containers 2 are continuously supplied to the labelling apparatus 20 in the normal case or in normal operation. This means that in normal operation there is a continuous sequence of containers 2, which are arranged in rows with a pre-determined interval between one another in each case, in a supply flow of containers 2 to the labelling apparatus 20. In a continuous sequence of containers 2 there are no container-absence points, which more precisely means that one container 2 follows directly after another container in front of the latter or in the row or sequence of containers. The direction of movement of the conveying turntables 40 and 50 is indicated with an arrow A along the periphery of one of the conveying turntables 40 in FIG. 2.

The reference number 60 in FIG. 2 designates a storage device for storing the labels and the reference number 61 in FIG. 2 designates a second detection device for detecting a pre-set filling state of the labels in the storage device. The storage device 60 and the second detection device 61 are described in greater detail below in conjunction with the second embodiment.

Figure 3:
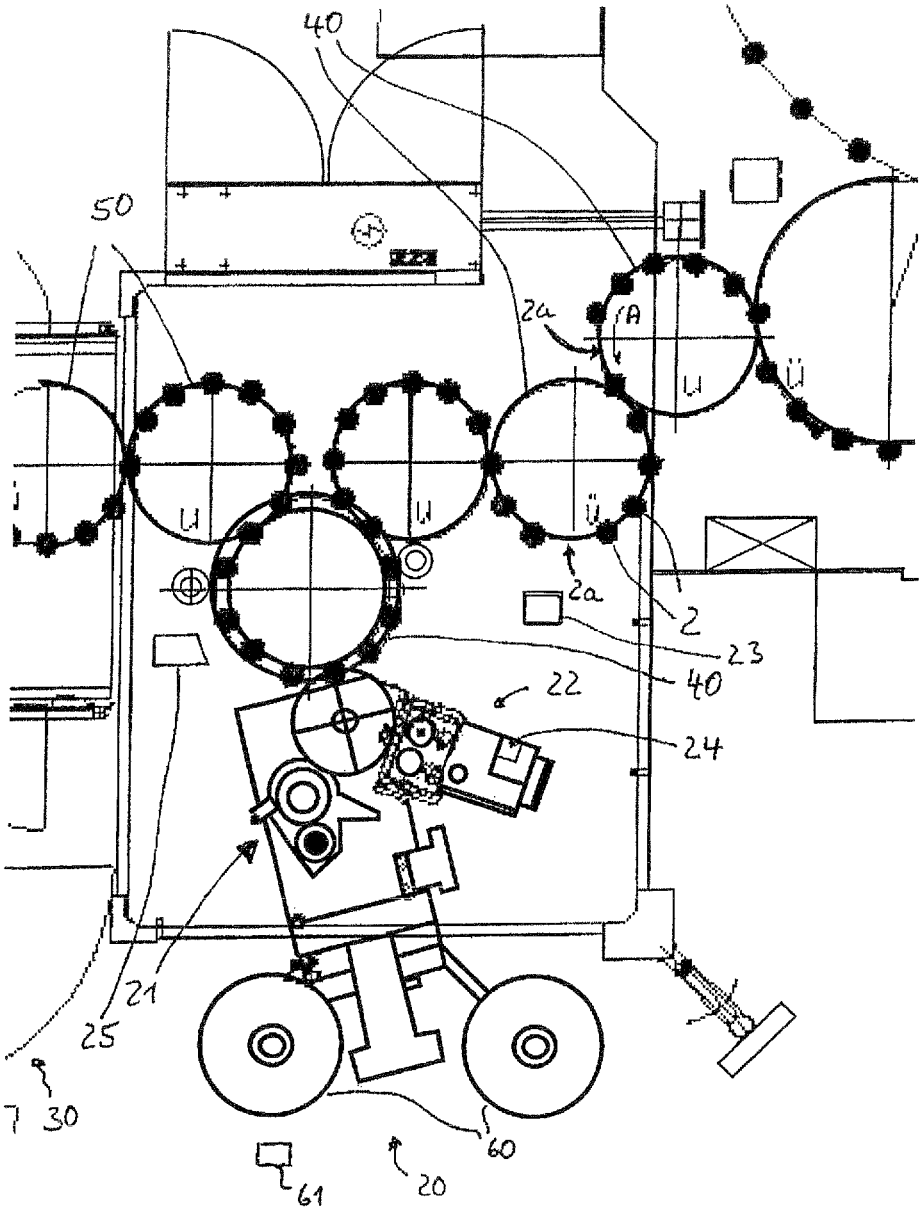
FIG. 3 is a diagrammatic plan view of a detail of the plant as shown in FIG. 1 in the case in which containers are discontinuously supplied to the labelling apparatus.

In contrast, FIG. 3 shows a case in which the containers 2 are supplied to the labelling apparatus 20 in a discontinuous manner. This means that that in the supply flow—shown in FIG. 3—to the labelling apparatus 20 a sequence of containers 2 is present on the conveying turntable 40, in which sequence the points indicated with arrows on the conveying turntable 40 have in each case a container 2 absent or a gap present which corresponds to an absent container 2 in the supply flow. Such a point is designed with the reference 2*a* in FIG. 3 and is also referred to below as a container-absence point 2*a*. The direction of movement of the conveying turntables 40 and 50 is likewise indicated in FIG. 3 with the arrow A along the periphery of one of the conveying turntables 40

In the case shown in FIG. 3 a number of five containers 2 are present between the two container-absence points 2*a* indicated with arrows in the continuous sequence of the containers 2. Such a configuration forms a pattern in the supply flow to the labelling apparatus 20 which has no effect upon the reliability of the plant 1. This means that even if the strip of labels is stopped in the case illustrated in FIG. 3, there is a sufficiently large number of containers 2 available between the container-absence points 2*a*, so that there is sufficient time to re-set the labelling apparatus 20 again after a stoppage of the strip of labels.

Figure 4:
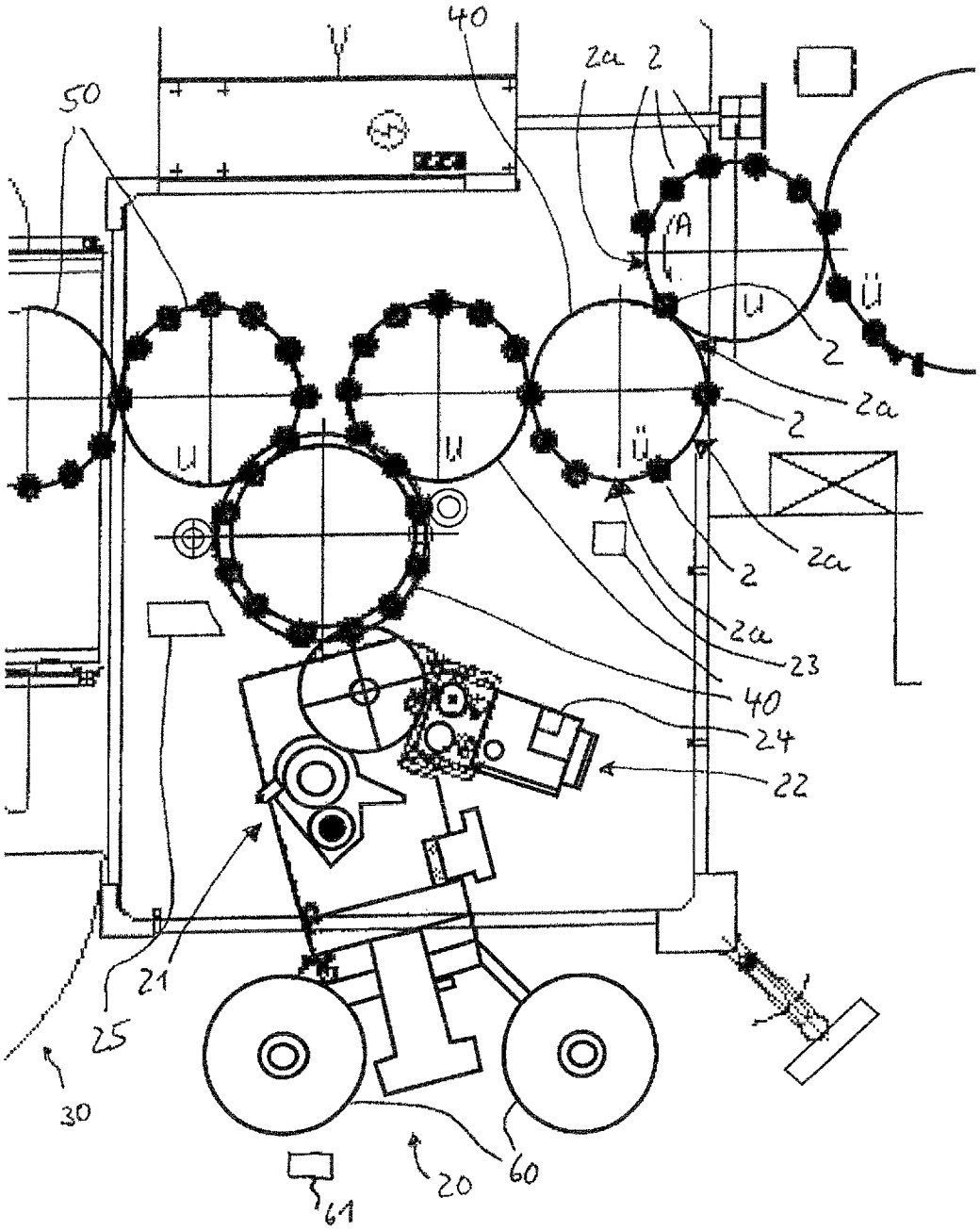
FIG. 4 is a further diagrammatic plan view of a detail of the plant as shown in FIG. 1 in the case in which containers are discontinuously supplied to the labelling apparatus.

FIG. 4 on the other hand shows a case in which containers 2 are supplied to the labelling apparatus. 20 in a discontinuous manner and which can lead to a tearing of the strip of labels if the strip of labels is stopped on account of each container-absence point 2*a* and is then set in motion again for one container 2 following after the container-absence point 2*a*.

In FIG. 4 the container-absence points 2*a* in the continuous sequence of containers 2 are again indicated with arrows. In this case, however, in FIG. 4 a sequence of a container 2 and a container-absence point 2*a*, in which only one container 2 is absent between the containers 2, is present in the supply flow of the containers 2 to the labelling apparatus 20 in such a way that this sequence is repeated several times in succession. This means that only one container 2 is present in each case between each container-absence point 2*a* at which only one container 2 is absent between the containers 2. To express it more precisely, the example shown in FIG. 4 is the following sequence: container-absence point 2*a*/container 2/container-absence point 2*a*/container 2/container-absence point 2*a*/container 2/container-absence point 2*a*.

If a detection device, which is designated below as the first detection device 23 and is indicated diagrammatically in FIG. 2 to FIG. 5, detects a pattern as illustrated in FIG. 4 in the supply flow of the containers 2 to the labelling apparatus 20, a control device 24 which is likewise indicated diagrammatically in FIG. 2 to FIG. 5 evaluates this pattern as being critical for a stoppage of the labelling apparatus 20 and, in particular, a stoppage of the strip of labels. The control device 24 thus extends the container-absence points 2*a* in such a way that the entire sequence of containers 2 and container-absence points 2*a*, which is repeated several times in succession in FIG. 4, is treated as a whole as a labelling gap.

Treatment as a labelling gap by the control device 24 means re-writing by the control device of a control program carried out by the control device.

In a labelling gap of this nature the labelling is interrupted by means of the labelling apparatus 20 or the labelling device 22 of the labelling apparatus 20. This means generally that the strip of labels is stopped during the time of the labelling gap. Consequently the cutting device 21 and the labelling device 22 are also stopped.

Figure 5:
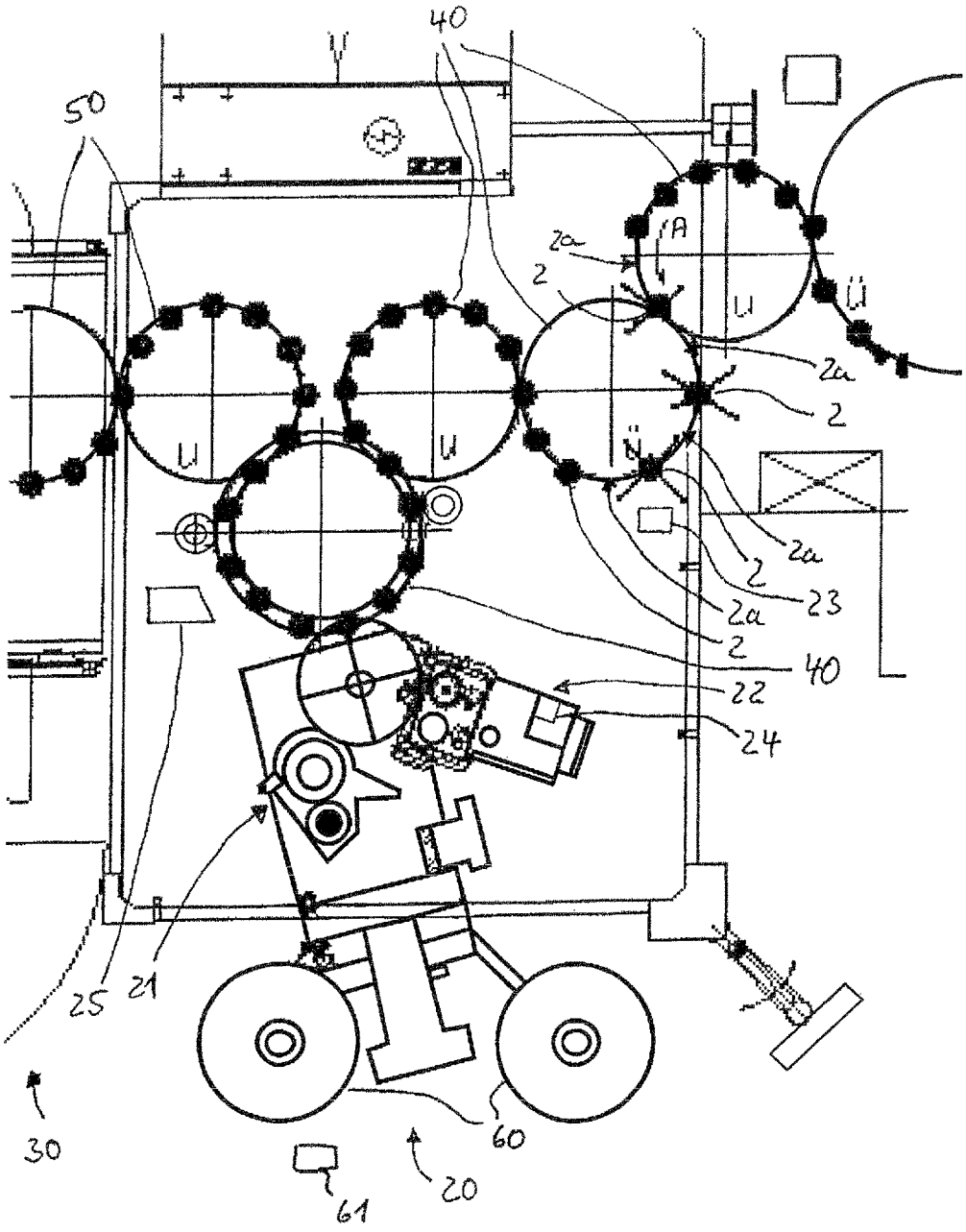
FIG. 5 is a still further diagrammatic plan view of a detail of the plant as shown in FIG. 1 in the case in which containers are discontinuously supplied to the labelling apparatus.

To express it more precisely, the control device 24 stops the strip of labels during the entire time which corresponds to a time which the conveying turntables 40 need to move a pattern comprising container-absence point 2*a*/container 2/container-absence point 2*a* etc., which is present in the supply flow of containers 2, past the labelling apparatus 20. As a consequence of the introduction of the above-described labelling gap through the control device 24 the containers 2 present in each case between the individual container-absence points 2*a* are not labelled by the labelling device 22 of the labelling apparatus 20. In FIG. 5 such containers 2 are crossed-out or are additionally indicated with a cross (×).

The control device 24 ends the labelling gap if a continuous sequence of the containers 2 is again present in the supply flow of the containers 2, as shown in FIG. 3 This means that the control device 24 ends the labelling gap if a continuous sequence of preferably five containers 2 again follows a container-absence point 2*a* or is detected by the first detection device 23. As a result, the control device 24 causes sufficient time to be available to re-set the labelling apparatus 20 again after the stoppage of the strip of labels.

In order that the plant 1 should not dispense non-labelled containers 2 or containers 2 not labelled, the plant 1 or the labelling apparatus 20 has a separation device 25 which is illustrated diagrammatically in FIG. 2 to FIG. 5 and at which those containers 2 are separated out which for example are not provided with a label by the labelling apparatus 20 after the treatment through the labelling gap artificially introduced by the control device 24. It is preferable for the separation device 25 to be arranged in such a way that it separates out the containers 2 which have not been labelled, before they are filled by the filling apparatus 30.

The containers 2 separated out by means of the separation device 25 can for example be supplied for labelling to another labelling apparatus 20 which operates as an individual apparatus and which is not incorporated in the plant 1.

Viewed as a whole, therefore, the following process occurs: If a combination which is hazardous for the labelling is recognizable or is detected by the first detection device 23, then the control device 24 extends this gap or container-absence point 2*a* by a special artificial re-writing process, until after a non-hazardous combination is achieved, i.e. until the extended gap or the labelling gap is followed by a continuous sequence of a pre-determined number of containers 2, in this example five containers 2, for the re-setting procedure of the labelling apparatus 20. The re-writing process results in a non-labelling and subsequent separation out of the consequently non-labelled container or containers 2 by the separation device 25 between the gaps or container-absence points 2*a*. In this way, an interruption of production can be effectively prevented.

(Second Embodiment)

Apart from the basis for determining whether the labelling of the containers 2 is interrupted, the second embodiment is identical to the first embodiment. Only those parts of the second embodiment which are different from the first embodiment will therefore be described below. The same parts and parts having the same significance are provided with the same reference numbers.

The labelling apparatus according to the second embodiment has, as shown in FIG. 2 to FIG. 5 and as mentioned above, a storage device 60 for storing the labels and a second detection device 61 for detecting a pre-determined filling state of the labels in the storage device 60.

The second detection device 61 is designed in such a way that each roll of labels on which a strip of labels is wound up has attached thereto a sensing means which detects the end of the roll of labels and is linked to the control device 24, i.e. it can send its detection signals to the control device 24. To express it more precisely, the second detection device 61 detects a predetermined filling state of the labels in the storage device 60.

When the second detection device 61 detects an end of the roll of labels, the control device 24 transfers a settable number of labels or containers 2 or spacings for a sequence signal "Close container barrier" to the pre-form conveyor and/or the blow-moulding machine. This signal results in a stoppage of the supply of pre-forms to the heating device of the stretch blow-moulding apparatus 10 and/or of heated pre-forms to the blow-moulding device of the stretch blow-moulding apparatus 10 This stoppage is only temporary, however, i.e. it lasts only for a specific duration which is necessary in order to apply a specific settable number of labels or to convey containers 2.

On account of this, the stretch blow-moulding apparatus 10 does not run completely empty after the signal "Close container barrier", but only a settable gap (for example 10 labels or containers 2 or spacings) is formed, which is sufficient to glue securely the rolls of labels following in succession. In this way, the gluing of the rolls of labels need not take place during a movement as previously customary, but it can take place during the stoppage of the rolls of labels.

The control device 24 is designed in such a way that it controls the labelling apparatus 20 and the filling apparatus 30 at a settable minimum speed after the signal "Close container barrier", until the automatic gluing of the rolls of labels following in succession is concluded. After the gluing the control device 24 controls the plant 1, which comprises the stretch blow-moulding apparatus 10 the labelling apparatus 20 and the filling apparatus 30, again at the speed set before the gluing or before the signal "Close container barrier".

This means that the control device 24 interrupts for example the labelling of the containers 2, as it stops the strip of labels for the duration of a settable gap or label gap which has arisen on account of the signal "Close container barrier".

Instead of the signal "Close container barrier" the strip of labels can also be stopped for the duration of a label gap in which, although the stretch blow-moulding apparatus 10 continues to run at the previous speed, the containers 2 produced "in excess" by the stoppage of the strip of labels are separated out by means of the separation device 25 upstream or downstream of the labelling apparatus 20.

(Third Embodiment)

Apart from the design of the labelling apparatus, the third embodiment is identical to the first embodiment. Only those parts of the third embodiment which are different from the first embodiment will therefore be described below. The same parts and parts having the same significance are provided with the same reference numbers.

The labelling apparatus according to the third embodiment has two cutting devices or label-strip bending devices and two labelling devices. In this case one cutting device or label-strip bending device is associated with one labelling device. The two cutting devices or label-strip bending devices and the two labelling devices are also referred to below as the first and second cutting devices or label-strip bending devices and the first and second labelling devices. The first cutting device or label-strip bending device and the first labelling device of the second embodiment are identical with the first cutting device 21 and the first labelling device 22 of the first embodiment.

The first cutting device 21 cuts a label from a first strip of labels and guides it to the first labelling apparatus. The second cutting device cuts a label from a second strip of labels and guides it to the second labelling apparatus. At least the first labelling device 22 is arranged on one side of the common supply flow of the containers 2 to the labelling apparatus 20, whereas at least the second labelling device is arranged on another side of the common supply flow of the containers 2 to the labelling apparatus 20. It is also advantageous if the first cutting device 21 is also arranged on the same side of the common supply flow of the containers 2 to the labelling apparatus 20 as the first labelling device 22. In addition, it is advantageous if the second cutting device is also arranged on the same side of the common supply flow of the containers 2 to the labelling apparatus 20 as the second labelling device.

As a result of the afore-mentioned correlation of the first and second cutting devices and the first and second labelling devices, the labelling apparatus according to this embodiment can perform a tandem operation in which the first labelling device and the second labelling device apply a label in an alternate manner to every second container 2 of the common supply flow of the containers 2 to the labelling apparatus 20.

The plant 1 thus comprises, in addition to the first detection device 23 named in conjunction with the first embodiment, a further detection device. The two detection devices are also referred to below as the first and third detection devices.

The first and third detection devices carry out a detection in each case for every second container in the supply flow of the containers 2 to the labelling apparatus 20. This means that the detection of the first and third detection devices is offset by one container 2 or one stroke with respect to each other. As a result, the control device 24 also carries out a control of the labelling of the containers 2 on the basis of a detection result of the first and third detection devices.

In this case the control device 24 is designed in such a way that it determines and sets a labelling gap for the first labelling device 22 separately from a labelling gap for the second labelling device. This means that in this embodiment the determination and setting of the labelling gap by the control device 24 is offset by one container 2 or one stroke for the first labelling device 22 with respect to the determination and setting of the labelling gap by the control device 24 for the second labelling device.

In this embodiment, however, the determination and setting of the respective labelling gap for the first and second labelling devices are carried out in the same way as described in the first embodiment and so are not described once again.

(General)

All the arrangements of the plant 1 described above can be used individually or in any possible combinations. In this case in particular the following modifications are possible:

As already described in the case of the first embodiment, the labelling is interrupted in a labelling gap by means of the labelling apparatus 20 or the labelling device 22 of the labelling apparatus 20, even if this generally means that the strip of labels is stopped for the duration of the labelling gap. It is also possible, however, for only the operation of the labelling device 22 to be stopped whilst the cutting device 21 is further in operation. The labels cut by the cutting device 21 from the strip of labels not stopped and continuing to run during the stoppage of the labelling device 22 can then be collected and optionally supplied to another labelling apparatus which has a labelling device 22 to which labels are supplied not from a strip of labels but from a stack of labels. The labels could also be attached by hand to containers 2 separated out by the separation device 25 and not labelled. Since another such labelling apparatus however, is usually not present in addition to a plant 1 and labelling the containers 2 by hand is awkward and expensive, the variant described above with reference to the first embodiment is preferable, in which not only the labelling device 22 but also the strip of labels and thus also the cutting device 21 are stopped.

It is preferable for the length of the labelling gap to be selected by the control device 24 in such a way that the first container 2 of a continuous sequence of preferably five containers 2 can be correctly labelled again Even if in the second embodiment a first and a second detection device are mentioned which carry out the detection in each case for every second container in the supply flow of the containers to the labelling apparatus 20, it is also possible for only one detection device to be present which has one sensor in each case at a plurality of points which is able to detect a container 2 or a container-absence point 2*a*. The points at which a sensor is present in each case are offset from one another by the distance which corresponds to the width of a container 2 and a distance between the containers 2 on the conveying turn table 40 or the distance between the containers 2 in a continuous sequence of containers 2 in the supply flow of the containers to the labelling apparatus 20. The detection device comprising a plurality of sensors can then in a pre-determined stroke detect a specified number of containers 2, i.e. as many containers 2 and container-absence points 2*a* as sensors of the detection device are present. In this case the predetermined stroke has a duration which corresponds to the length of time that a container 2 or a container-absence point 2*a*, at which a container 2 is absent, takes to pass one of the sensors of the detection device in each case. The control device 24 can carry out the determination and setting of the labelling gap with the same stroke on the basis of a detection result of the detection device and then control the labelling apparatus 20 on this basis. In this case, however, the control device 24 is still designed in such a way that it determines and sets a labelling gap for the first labelling device 22 separately from a labelling gap for the second labelling device.

The first detection device 23, which is named in conjunction with the first embodiment, can comprise a plurality of sensors in the manner described in the case of the preceding modification, and can detect the pattern of containers 2 and container-absence points 2*a* in the stroke in each case, as described above.

It is preferable for the detection device, which comprises a plurality of sensors, to have the number of eight sensors.

Instead of only one labelling apparatus 20 as in the case of the first embodiment or one labelling apparatus which has a first and second cutting device and a first and second labelling device which carry out a tandem operation in which the first labelling device and the second labelling device apply a label in an alternate manner to every second container 2 of the common supply flow of the containers 2 to the labelling apparatus 20 as described in the case of the third embodiment, it is also possible for more than two strips of labels, more than two cutting devices and more than two labelling devices to be present which, as described in the case of the third embodiment, are arranged on the common supply flow of the containers 2 to the labelling apparatus 20 and label containers in an alternate and reciprocal manner in the supply flow of the containers 2 to the labelling apparatus 20. By way of example, in the case of three strips of labels, three cutting devices and three labelling devices, each of the labelling devices can label only every third container 2. In the case of four strips of labels, four cutting devices and four labelling devices, each of the labelling devices can label only every fourth container 2 etc. This means that the strips of labels, cutting devices and labelling devices can be arranged in succession both on both sides of the supply flow of the containers 2 on the conveying turntables 40 and on one side of the conveying turntable 40.

The labelling apparatus in the second embodiment can likewise be provided with more than one labelling device, as described in the case of the third embodiment. In addition, numerous combinations of this application would also be possible, for example more than two labelling units. An application is also possible, in particular, in labelling modules with automatic gluing in block operation.

At least the conveying turntable 40 can be designed in the form of a conveyor belt at least in the region of the labelling apparatus 20. This is particularly advantageous when a plurality of strips of labels, cutting devices and labelling devices are present.

The arrangement of the first detection device 23, the control device 24 and the separation device 25 is illustrated only diagrammatically in FIG. 2 to FIG. 5. The precise arrangement of these devices in the plant 1, however, is not restricted to the arrangement shown in FIG. 2 to FIG. 5. Other arrangements inside the plant 1 are also possible, provided that the above-described operations of the devices 23, 24, 25 can be achieved with such arrangements. The precise design of the first detection device 23, the control device 24 and the separation device 25 is obvious in a simple manner to the person skilled in the art and is therefore not described in greater detail here.

All the features disclosed in the application documents are claimed as being essential to the invention, insofar as they are novel either individually or in combination as compared with the prior art.

LIST OF REFERENCES

1 plant
2 container
2*a* container-absence point
10 blow-moulding device
20 labelling apparatus
21 cutting device
22 labelling device
23 first detection device
24 control device
25 separation device
30 filling apparatus
40 conveying turntable
50 conveying turntable
60 storage device
61 second detection device
A direction of rotation of the conveying turntables

The invention claimed is:

1. A labelling process for the labelling of containers by a labelling apparatus which comprises at least one first labelling device for applying a label cut from the first strip of labels to a container, and a storage device for storing the labels, the steps of transporting a supply flow of containers in an upright position/orientation to a first labelling device, detecting-in a first detection step-a pattern of containers and container-absence points in the supply flow of containers oriented in said upright position/orientation, and controlling the labelling of the containers to those containers in said upright position/orientation, on the basis of a detection result of the detection step, transporting a sequence of containers with present and container-absence points, temporarily detecting container-absence points, and temporarily interrupting the labelling step while maintaining the transporting of the containers, and restarting the labelling after a sequence of containers in an upright position/orientation, is detected.

2. The labelling process according to claim 1, wherein the labelling apparatus additionally comprises a second labelling device for applying a label from a second strip of labels to a container, wherein the first and second labelling devices applying a label in an alternate manner to every second container of a common supply flow of the containers to the labelling apparatus, and the process additionally comprises:

detecting-in a second detection step-a pattern of containers and container-absence points in a supply flow of the containers to the second labelling device and/or a filling state of the labels in the storage device, and controlling the labelling of the containers on the basis of a detection result of the first and the second labelling steps.

3. The labelling process according to claim 1, additionally comprising the step of separating out the plastics-material containers not labelled by the labelling apparatus from the flow of plastics-material containers.

4. The labelling process according to claim 1, wherein a filling state of the labels in the storage device is also detected in the first detection step.

5. The labelling process according to claim 1, wherein the labelling of the containers is temporarily interrupted, if the first detection device detects a pre-determined pattern of containers and container-absence points.

6. The labelling process according to claim 5, wherein the pre-determined pattern is a pattern of containers and container-absence points which can lead to a tearing of the strip of labels when the strip of labels is stopped at each container-absence point.

7. The labelling process according to claim 1, wherein a pattern of containers and container-absence points-which is detected by the first detection device and which can lead to a tearing of the strip of labels if the strip of labels, is stopped at each container-absence point-as a whole, is treated as a labelling gap between the containers.

8. The labelling process according to claim 7, wherein the strip of labels is stopped for the duration of the labelling gap.

9. The labelling process according to claim 7, wherein the labelling is stopped in such a way, that containers present between the individual container- absence points are not labeled.

10. The labelling process according to claim 7, wherein as a consequence of the labelling gap, the containers present in each case between the individual container-absence points are not labeled by the labelling device.

11. The labelling process according to claim 1, wherein a pre-determined pattern of containers and container-absence points-which is detected by the first detection device-as a whole, is treated as a labelling gap which is provided between two continuous sequences of containers in which no container-absence point is present in the supply flow of the containers to the first labelling device and which comprise at least one pre- determined number of containers.

12. The labelling process according to claim 11, wherein the pre-determined pattern is a pattern of containers and container-absence points which can lead to a tearing of the strip of labels when the strip of labels is stopped at each container-absence point.

13. The labelling process according to claim 11, wherein the strip of labels is stopped for the duration of the labelling gap.

14. The labelling process according to claim 11, wherein the labelling is stopped in such a way, that containers present between the individual container- absence points are not labeled.

15. The labelling process according to claim 11, wherein as a consequence of the labelling gap, the containers present in each case between the individual container-absence points are not labeled by the labelling device.

16. The labelling process according to claim 1, wherein the containers are transported via a transport star wheel to the labelling apparatus.

* * * * *